US006083328A

United States Patent [19]

Gravemann et al.

[11] Patent Number: 6,083,328

[45] Date of Patent: Jul. 4, 2000

[54] CASTING ROLLS MADE OF HARDENABLE COPPER ALLOY

[75] Inventors: Horst Gravemann; Thomas Helmenkamp, both of Osnabrück, Germany

[73] Assignee: KM Europa Metal AG, Osnabrück, Germany

[21] Appl. No.: 08/239,439

[22] Filed: May 6, 1994

Related U.S. Application Data

[63] Continuation of application No. 07/994,385, Dec. 21, 1992, abandoned.

[30] Foreign Application Priority Data

Dec. 24, 1991 [DE] Germany ..... 41 42 941

[51] Int. Cl.[7] ..... C22C 9/06; B22D 11/06

[52] U.S. Cl. ..... 148/432; 148/435; 420/485; 420/488; 420/496

[58] Field of Search ..... 148/432, 435, 148/553, 554; 420/485, 488, 496

[56] References Cited

U.S. PATENT DOCUMENTS

| | | | |
|---|---|---|---|
| 3,196,006 | 7/1965 | Lane | 148/411 |
| 4,179,314 | 12/1979 | Wikle | 148/685 |
| 4,657,601 | 4/1987 | Guha | 148/435 |
| 4,792,365 | 12/1988 | Matsui et al. | 148/685 |
| 5,074,922 | 12/1991 | Hiramitsu et al. | 148/554 |

FOREIGN PATENT DOCUMENTS

| | | |
|---|---|---|
| 1-165736 | 6/1989 | Japan . |

*Primary Examiner*—Sikyin Ip
*Attorney, Agent, or Firm*—Kenyon & Kenyon

[57] ABSTRACT

A hardenable copper alloy, suitable as a material for manufacturing casting rolls and casting wheels that are subjected to changing temperature stresses, is disclosed. The hardenable copper alloy comprises 1.0 to 2.6% nickel, 0.1 to 0.45% beryllium, and the remainder of copper, inclusive of impurities resulting from manufacturing and the customary processing additives, and has a Brinell hardness of at least 200 and an electric conductivity of over 38 m/Ω mm$^2$.

14 Claims, No Drawings

CASTING ROLLS MADE OF HARDENABLE COPPER ALLOY

This application is a continuation of application Ser. No. 07/994,385filed on Dec. 21, 1992, now abandoned.

BACKGROUND OF THE INVENTION

The invention relates to a hardenable copper alloy used for manufacturing casting rolls and casting wheels that are subjected to changing temperature stresses.

A world-wide goal, particularly of the steel industry, is to cast a semi-finished product as close as possible to the dimensions of the final product in order to economize on hot and/or cold working steps. Since about 1980, a series of developments have evolved to cast semi-finished products close to final dimensions, for example the single- and double-roll continuous casting methods. When these casting methods are utilized for casting steel alloys, nickel, copper, and their alloys, very high surface temperatures arise in the area of the water-cooled cylinders or rolls where smelt is poured in. For example, these temperatures lie in a range of 350° to 450° C. when steel alloy is cast, and the casting rolls consist of a CuCrZr material having an electric conductivity of 48 m/Ω/mm$^2$ and a thermal conductivity of about 320 W/mK.

Until now, materials based on CuCrZr have been used primarily for highly thermally stressed continuous casting molds and casting wheels. When these materials are used for casting rolls, the cooling of the casting rolls causes the surface temperature of the region immediately ahead of the pour-in area to drop off cyclically with every revolution, to about 150° to 200° C. On the other hand, on the cooled side of the casting rolls, the temperature remains largely constant during the rotation, at about 30° to 40° C. The temperature gradient between the surface and the cooled side, combined with the cyclical change in the surface temperature of the casting rolls, produce considerable thermal stresses in the surface area of the roll material.

Fatigue tests carried out on previously employed CuCrZr material, having an expansion amplitude of ±0.3% and a frequency of 0.5 Hz, which correspond to a 30 r.p.m. speed of rotation for the casting rolls, indicate that at a maximum surface temperature of 400° C., which corresponds to a wall thickness of 25 mm above the water cooling, one can expect a lifetime of 3000 cycles before the formation of cracks occurs. The casting rolls would, therefore, have to be reworked after a relatively short operating time of about 100 minutes to remove surface cracks. Replacing the casting rolls necessitates stopping the casting machine and interrupting the casting operation.

Another disadvantage of the CuCrZr material is its Brinell hardness of about 110 to 130, which is relatively low for this application. Steel splashes cannot be avoided in the single- or double-roll continuous casting method in the region immediately ahead of the pour-in area. The solidified steel particles are then pressed into the relatively soft surface of the casting rolls, thus adversely affecting the surface quality of the 1.5 to 4 mm thick cast bands.

The lower electrical conductivity of a known CuNiBe-alloy with an admixture of up to 1% niobium leads to a higher surface temperature, compared to a CuCrZr alloy, since the electrical conductivity is inversely proportional to the thermal conductivity. The surface temperature of a casting roll made of the CuNiBe-alloy, compared to a casting roll of CuCrZr with a maximum temperature of 400° C. on the surface and 30° C. on the cooled side, will increase to about 540° C.

Generally, ternary CuNiBe-, or rather CuCoBe-alloys do in fact exhibit a Brinell hardness of over 200. However, the electric conductivity of the standard types of semi-finished products manufactured from these materials, such as rods for manufacturing resistance welding electrodes, or sheet metal and bands for manufacturing springs or lead frames, reaches values lying only in the range of 26 to 32 m/Ω/mm$^2$. Under optimal conditions, a casting roll surface temperature of only about 585° C. would be reached using these standard materials.

Finally, for the CuCoBeZr or CuNiBeZr alloys, generally known from the U.S. Pat. No. 4,179,314, there is no indication that conductivity values greater than 38 m/Ω/mm$^2$ are achievable in conjunction with a minimum Brinell hardness of 200 when alloy components are selectively chosen.

SUMMARY OF THE INVENTION

The object of the present invention is to make available a material for manufacturing casting rolls, casting roll shells and casting wheels, which is insensitive to the stress of changing temperatures at pouring rates of above 3.5 meter/min, or which demonstrates a high resistance to fatigue at the working temperature of the casting rolls.

A hardenable copper alloy that has proven to be particularly suited for this application comprises of 1.0 to 2.6% nickel, 0.1 to 0.45% beryllium, the remainder of copper, inclusive of impurities resulting from manufacturing and the customary processing additives, and has a Brinell hardness of at least 200 and an electric conductivity of over 38 m/Ω/mm$^2$. The mechanical properties, in particular the tensile strength, can be further improved by adding 0.05 to 0.25% zirconium.

Preferably, copper alloys of the present invention have a ratio of nickel content to beryllium content of at least 5:1, given a nickel content in the alloying composition of over 1.2%. The mechanical properties can be further improved when up to 0.15% is added from at least one element selected from the following group: niobium, tantalum, vanadium, titanium, chromium, cerium and hafnium.

Surprisingly, standardized tests according to ASTM and DIN, show that at nickel contents of 1.1 to 2.6%, it is possible to achieve the properties required for the casting rolls when casting close to final dimensions—i.e., a Brinell hardness of >200 and an electric conductivity of at least 38 m/Ω/mm$^2$. It is also possible to achieve a high fatigue resistance when the nickel content is in a defined proportion to the beryllium content, and when an adapted thermal or thermomechanical treatment is carried out.

Similar results and advantages may be achieved by substituting cobalt for nickel in the copper alloys of the present invention.

DETAILED DESCRIPTION

The invention will be clarified in greater detail based on a few exemplified embodiments. On the basis of four alloys (alloys F through K) according to the invention and four comparative alloys (alloys A through D), it will be demonstrated how critical the composition is in achieving the combination of desired properties. The compositions of the representative alloys are indicated in Table 1 in percent by weight. The corresponding test results are summarized in Table 2.

TABLE 1

| Alloy | Ni | Be | Cu |
|---|---|---|---|
| A | 1.43 | 0.54 | remainder |
| B | 1.48 | 0.40 | remainder |
| C | 1.83 | 0.42 | remainder |
| D | 2.12 | 0.53 | remainder |
| F | 1.48 | 0.29 | remainder |
| G | 1.86 | 0.33 | remainder |
| H | 1.95 | 0.30 | remainder |
| K | 2.26 | 0.35 | remainder |

TABLE 2

| Alloy Conductivity | Ni/Be | Brinell Hardness (2.5/187.5) | m/Ω/mm$^2$ |
|---|---|---|---|
| A | 2.6 | 193 | 30.9 |
| B | 3.7 | 224 | 36.1 |
| C | 4.4 | 235 | 37.0 |
| D | 4.0 | 229 | 33.9 |
| F | 5.1 | 249 | 39.4 |
| G | 5.6 | 247 | 38.5 |
| H | 6.5 | 249 | 39.8 |
| K | 6.5 | 249 | 39.8 |

The hardness and conductivity values attained for alloys having different nickel and beryllium contents—corresponding to different Ni/Be ratios—are indicated in Table 2. All of the alloys were smelted in a vacuum furnace, hot-formed and, after undergoing a solution treatment at 925° C. for at least one hour and a subsequent rapid cooling in water for 4 to 32 hours, were hardened at a temperature in the range of 350° to 550° C.

From the case of the alloys F, G, H and K, which are embodiments of the present invention, one can discern that the combination of desired properties can be achieved when the proportion by weight of nickel to beryllium is at least 5:1. When the casting rolls, or casting roll shells undergo an additional cold working by about 25% after the solution treatment, a further improvement in the electric conductivity is achievable.

Thus, for example, an alloy having 1.48% nickel and an Ni/Be proportion of at least 5.1 achieves a conductivity of 43 m/Ω/mm$^2$ and a Brinell hardness of 225 after undergoing a 32-hour hardening treatment at 480° C. As the nickel content goes up, the properties can be optimized still further by increasing the Ni/Be proportion. A copper alloy having 2.26% nickel and an Ni/Be proportion of 6.5 exhibits a Brinell hardness of 230 and an electric conductivity of 40.5 m/Ω/mm$^2$, after undergoing a 32-hour hardening treatment at 480° C. To achieve the desired property combination one can utilize a nickel content of 2.3% and an Ni/Be proportion of 7.5, as upper limits, for example.

The composition and properties of seven other alloys according to the present invention are listed in Tables 3 and 4. All of the alloys were heat-treated at 925° C., cold-formed by 25% and subsequently subjected to a 16-hour hardening treatment at 480° C.

TABLE 3

| Alloy | Ni % | Be % | Zr % | Cu |
|---|---|---|---|---|
| L | 1.49 | 0.24 | | remainder |
| M | 2.26 | 0.35 | | remainder |

TABLE 3-continued

| Alloy | Ni % | Be % | Zr % | Cu |
|---|---|---|---|---|
| N | 2.07 | 0.32 | 0.18 | remainder |
| O | 1.51 | 0.28 | 0.19 | remainder |
| P | 1.51 | 0.21 | 0.17 | remainder |
| R | 1.40 | 0.21 | 0.21 | remainder |
| S | 1.78 | 0.28 | 0.21 | remainder |

TABLE 4

| Alloy | Ni/Be | Yield point N/mm$^2$ | $R_m$ N/mm$^2$ | Elongation % | Brinell Hardness 2.5/187.5 | Conduct m/Ω/mm$^2$ |
|---|---|---|---|---|---|---|
| L | 6.2 | 681 | 726 | 19 | 244 | 40.2 |
| M | 6.5 | 711 | 756 | 18 | 255 | 40.1 |
| N | 6.5 | 682 | 792 | 18 | 220 | 38.6 |
| O | 5.4 | | | | 234 | 39.0 |
| P | 7.2 | | | | 211 | 40.9 |
| R | 6.3 | 626 | 680 | 15 | 217 | 41.1 |
| S | 6.3 | 662 | 712 | 13 | 223 | 40.8 |

One can also determine from these test results that high conductivity values are also achievable in conjunction with high Brinell hardness values for CuNiBe alloys having a zirconium additive, when the Ni/Be proportion of 5 to 7.5 is maintained. It is surprising that when up to 0.25% zirconium is added, the conductivity is only slightly lowered compared to a zirconium-free CuNiBe alloy, whereby a minimum value of 38 m/Ω/mm$^2$ is guaranteed. On the other hand, the zirconium additive provides processing advantages and improves the hot plasticity.

To more completely analyze fatigue performance, the representative alloy N was selected, since it exhibits a relatively low electric conductivity. When the alloy N is used, a maximum surface temperature of about 490° C. can be reached for a casting roll. When a casting roll is subjected to stresses previously known in casting steel, its lifetime is prolonged two to three times compared to a CuCrZr alloy. Furthermore, because of the high Brinell hardness, there is no danger of smelt splashes pressing into and damaging the surface of the casting roll.

Similar critical thermal cycling also occurs in casting wheels when wire rods are continuously cast using known Southwire and Properzi casting roll installations. For these processes as well, the CuNiBe(Zr) alloy according to the present invention is particularly well suited for manufacturing the casting wheels. Until now, these steel casting processes have not been successful, because of the inferior performance characteristics of the materials used for the casting wheels.

In the last three years, other methods have been developed for casting steel close to final dimensions, in which the copper molds reach extreme surface temperatures of up to 500° C. because of the extremely high pouring rates of 3.5 to about 7 m/min. To keep the friction between the molds and the steel strand as low as possible, it is also necessary to adjust high oscillation frequencies of 400 lifts/min and more. The periodically fluctuating bath level likewise subjects the mold to considerable fatigue stress in the meniscus area. This results in an inadequate lifetime for such molds. When the CuNiBe(Zr) alloys according to the invention are applied, their high fatigue resistance makes it possible to considerably increase the lifetime for this application, as well.

What is claimed is:

1. An article of manufacture comprising:

a casting roll or casting wheel comprised of a hardenable copper alloy comprising 1.0 to 2.6% nickel, 0.1 to 0.45% beryllium and the remainder of copper, wherein said alloy has a Brinell hardness of at least 200 and an electric conductivity of over 38 m/Ω/mm$^2$.

2. The article of manufacture of claim 1 wherein the hardenable copper alloy further comprises 0.05 to 0.25% of zirconium.

3. The article of manufacture of claim 1 wherein the hardenable copper alloy comprises 1.4 to 2.2% nickel;

0.2 to 0.35% beryllium and 0.15 to 0.2% zirconium.

4. The article of manufacture of claim 1 wherein the hardenable copper alloy comprises at least 1.2% nickel.

5. The article of manufacture of claim 4 wherein the hardenable copper alloy has a nickel-to-beryllium ratio of at least 5:1.

6. The article of manufacture of claim 4 wherein the hardenable copper alloy has a nickel-to-beryllium ratio of about 5.5:1 to about 7.5:1.

7. The article of manufacture of claim 1 wherein the hardenable copper alloy further comprises up to 0.15% of a metal selected from the group consisting of zirconium, niobium, tantalum, vanadium, titanium, chromium, cerium and hafnium.

8. An article of manufacture comprising:

a casting roll or casting wheel comprised of a hardenable copper alloy comprising 1.0 to 2.6% cobalt, 0.1 to 0.45% beryllium and the remainder of copper, wherein said alloy has a Brinell hardness of at least 200 and an electric conductivity of over 38 m/Ω/mm$^2$.

9. The article of manufacture of claim 8 wherein the hardenable copper alloy further comprises 0.05 to 0.25% of zirconium.

10. The article of manufacture of claim 8 wherein the hardenable copper alloy comprises 1.4 to 2.2% cobalt;

0.2 to 0.35% beryllium and 0.15 to 0.2% zirconium.

11. The article of manufacture of claim 8 wherein the hardenable copper alloy comprises at least 1.2% cobalt.

12. The article of manufacture of claim 11 wherein the hardenable copper alloy has a cobalt-to-beryllium ratio of at least 5:1.

13. The article of manufacture of claim 8 wherein the hardenable copper alloy has a cobalt-to-beryllium ratio of about 5.5:1 to about 7.5:1.

14. The article of manufacture of claim 8 wherein the hardenable copper alloy further comprises up to 0.15% of a metal selected from the group consisting of zirconium, niobium, tantalum, vanadium, titanium, chromium, cerium and hafnium.

* * * * *